US011385012B2

(12) United States Patent
Lipowski

(10) Patent No.: US 11,385,012 B2
(45) Date of Patent: Jul. 12, 2022

(54) SLIDABLE TRIGGER ASSEMBLY FOR FIREARM

(71) Applicant: 2360216 Ontario Inc., Mississauga (CA)

(72) Inventor: Mats Lipowski, Mississauga (CA)

(73) Assignee: 2360216 Ontario Inc., Mississauga (CA)

( * ) Notice: Subject to any disclaimer, the term of this patent is extended or adjusted under 35 U.S.C. 154(b) by 0 days.

(21) Appl. No.: 17/025,029

(22) Filed: Sep. 18, 2020

(65) Prior Publication Data

US 2021/0088300 A1 Mar. 25, 2021

Related U.S. Application Data

(60) Provisional application No. 62/902,706, filed on Sep. 19, 2019.

(51) Int. Cl.

| | |
|---|---|
| ***F41A 19/16*** | (2006.01) |
| ***F41A 19/12*** | (2006.01) |
| ***F41A 19/10*** | (2006.01) |

(52) U.S. Cl.

CPC ..... *F41A 19/16* (2013.01); *F41A 19/10* (2013.01); *F41A 19/12* (2013.01)

(58) Field of Classification Search

CPC ..... F41A 19/10; F41A 19/12; F41A 19/15; F41A 19/16

See application file for complete search history.

(56) References Cited

U.S. PATENT DOCUMENTS

| | | | | |
|---|---|---|---|---|
| 1,998,596 | A * | 4/1935 | Stiennon | F41A 19/16 42/69.01 |
| 3,024,559 | A * | 3/1962 | Weatherby | F41A 3/68 42/70.06 |
| 3,899,845 | A * | 8/1975 | Wild | F41B 11/00 42/69.01 |
| 3,950,876 | A * | 4/1976 | Wild | F41A 19/32 42/69.02 |
| 5,487,233 | A * | 1/1996 | Jewell | F41A 19/16 42/69.01 |
| 5,822,903 | A * | 10/1998 | Davis, Sr. | F41A 19/16 42/69.01 |
| 7,047,685 | B2 * | 5/2006 | Diaz | F41A 19/16 42/69.02 |
| 7,156,662 | B2 * | 1/2007 | Goko | F41A 19/16 362/111 |
| 7,331,136 | B2 * | 2/2008 | Geissele | F41A 19/16 42/69.03 |
| 9,046,313 | B1 * | 6/2015 | Button | F41A 19/44 |
| 9,170,063 | B2 * | 10/2015 | Krieger | F41A 19/16 |
| 10,451,379 | B2 * | 10/2019 | Heckert | F41A 19/16 |

FOREIGN PATENT DOCUMENTS

| | | | | |
|---|---|---|---|---|
| FR | 2572508 A1 * | 5/1986 | | F41A 19/16 |

* cited by examiner

*Primary Examiner* — Joshua T Semick
(74) *Attorney, Agent, or Firm* — Tarolli, Sundheim, Covell & Tummino LLP

(57) ABSTRACT

A slidable trigger assembly for a firearm is described. The slidable trigger comprises a main body housing a trigger and a sear and a slider, slidably coupled with the main body. The slidable trigger assembly may include a slide adjuster configured to set the sear at a target position with respect to the slider. Alternatively, the slider moves laterally in response to physical manipulation of the slidable trigger assembly to set the sear at a target position with respect to the slider.

18 Claims, 2 Drawing Sheets

SLIDABLE TRIGGER ASSEMBLY FOR FIREARM

This application claims priority from U.S. Provisional Patent Application No. 62/902,706 filed on Sep. 19, 2019. The present invention relates generally to a firearm trigger assembly and specifically to a slidable trigger assembly for a firearm.

BACKGROUND

Bolt-action firearms are well known in the art. Typically, a cartridge is fed into the receiver from an internal magazine by the forward movement of a bolt. After the shot is fired, the bolt is retracted, which removes the spent casing. The rearward movement of the bolt is limited by a stop machined into the bolt.

Some bolt-action firearms have a bolt-located safety that interacts with a notch in a firing pin assembly. However, due to an accumulation of tolerances in the components of the firearm, when assembling the firearm, the notch in the firing pin assembly may not accurately align with a safety cam that is part of the bolt assembly. In order to overcome this the cocking piece is often grinded to removing material in order to adjust the location of the notch in the firing pin assembly. However, this is laborious and time consuming, and adds an undesirable expense to the installation process.

Accordingly, it is object of the present invention to obviate or mitigate the above-mentioned disadvantage.

SUMMARY

In accordance with an aspect of an embodiment, there is provided a slidable trigger assembly comprising a main body housing a trigger and a sear; a slider, slidably coupled with the main body; and a slide adjuster configured to set the sear at a target position with respect to the slider.

In an embodiment, the main body comprises a flange protruding therefrom. The flange may comprise a flange bore and the slider comprises a slider bore. The flange bore may be larger than the slider bore. The flange bore and the slider bore may be aligned to receive a fastener therethrough. The slider bore may be shaped to snugly receive the fastener.

In an embodiment, the flange may comprise a channel shaped to receive the slider. The slider may include a protrusion, distal from an edge of the flange, the protrusion extending perpendicularly into the channel. The main body may comprise a pair of opposing slots, and the protrusion may be coupled to the main body by a pin extending through the protrusion between the opposing slots. The slider may be loosely coupled with the main housing, and the slide adjuster may be configured to set the position of the sear in place one it has been determined. The slider moves laterally in response to adjustment of the slide adjuster. The slide adjuster may comprise a set screw.

In accordance with an aspect of an embodiment, there is provided a slidable trigger assembly comprising: a main body housing a trigger and a sear, the main body comprising a flange bore; and a slider, slidably coupled with the main body, the slider comprising a slider bore smaller than the flange bore, wherein the flange bore and the slider bore are aligned to receive a fastener therethrough.

In an embodiment, the slider bore is shaped to snugly receive the fastener. The main body may comprise a channel shaped to receive the slider. The slider may include a protrusion, distal from an edge of the main body, the protrusion extending perpendicularly into the channel. The main body may comprise a pair of opposing slots, and the protrusion is coupled to the main by a pin extending through the protrusion between the opposing slots. The slider may move laterally in response to physical manipulation of the slidable trigger assembly to set the sear at a target position with respect to the slider.

BRIEF DESCRIPTION OF THE DRAWINGS

Embodiments of the invention will now be described by way of example only with reference to the following drawings in which.

DETAILED DESCRIPTION OF THE PREFERRED EMBODIMENTS

Figure 1:
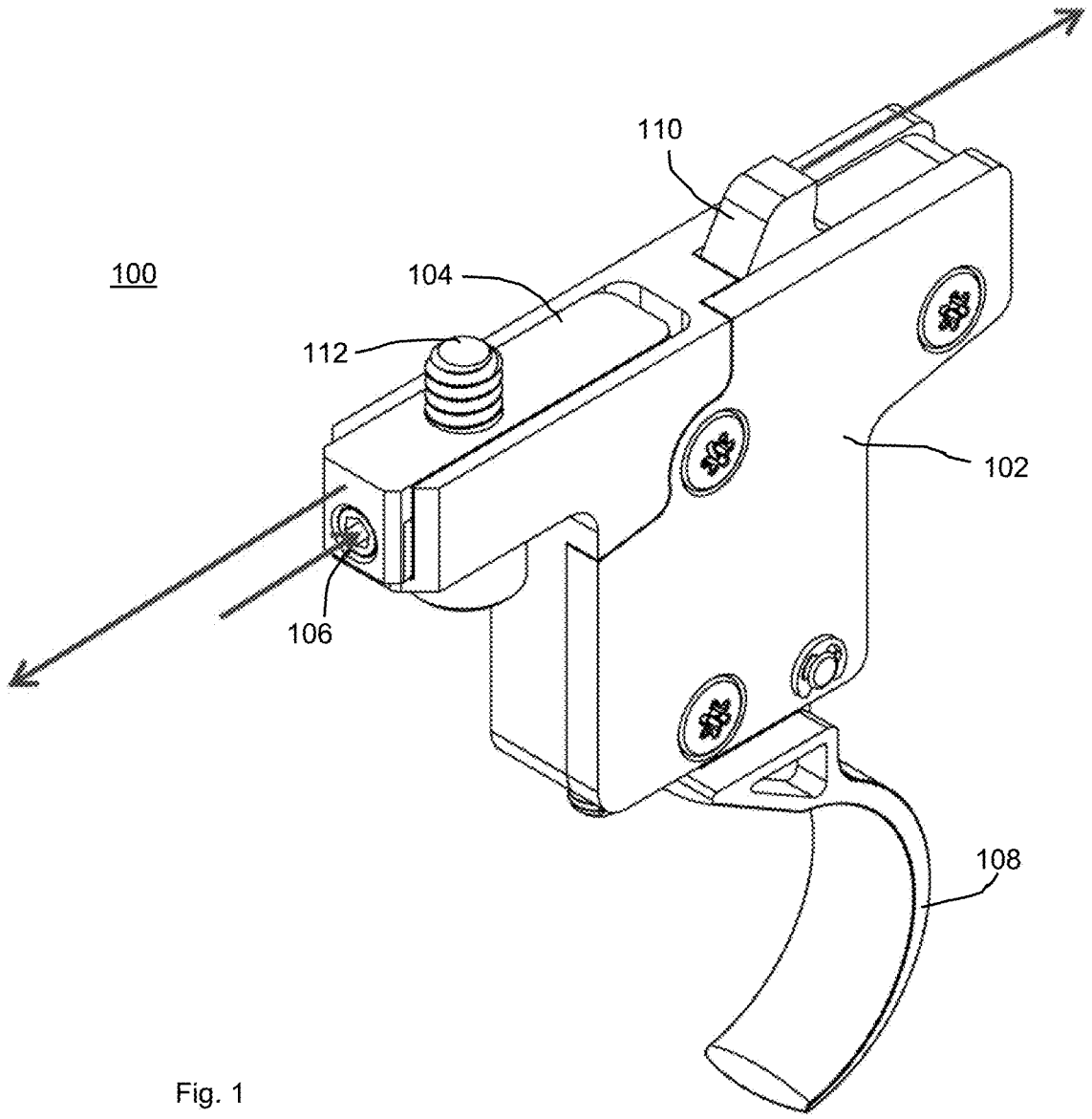
FIG. 1 is an isometric view of a trigger assembly in accordance with an aspect of an embodiment.

For convenience, like numerals in the description refer to like structures in the drawings. Referring to FIG. 1, a trigger assembly in accordance with an aspect of an embodiment it illustrated generally by numeral 100. The trigger assembly 100 comprises a main body 102, a slider 104, a slide adjuster 106, a trigger 108, a sear 110. As is known in the art, the sear 110 interfaces with a firing pin assembly of a firearm (not shown). When a user moves the trigger 108 past a predefined point, the sear 110 drops releasing the firing pin assembly of the firearm. Many different mechanisms, known and proprietary, exist to couple trigger 108 with the sear 110. However, such mechanisms are beyond the scope of the present invention.

The slider 104 is slidably coupled with the main body 102. The slide adjuster 106 is configured to laterally change the position of the slider 104 with respect to the main body 102. As will be described, changing the position of the slider 104 with respect to the main body 102 changes the lateral position of the sear 110.

Figure 2:
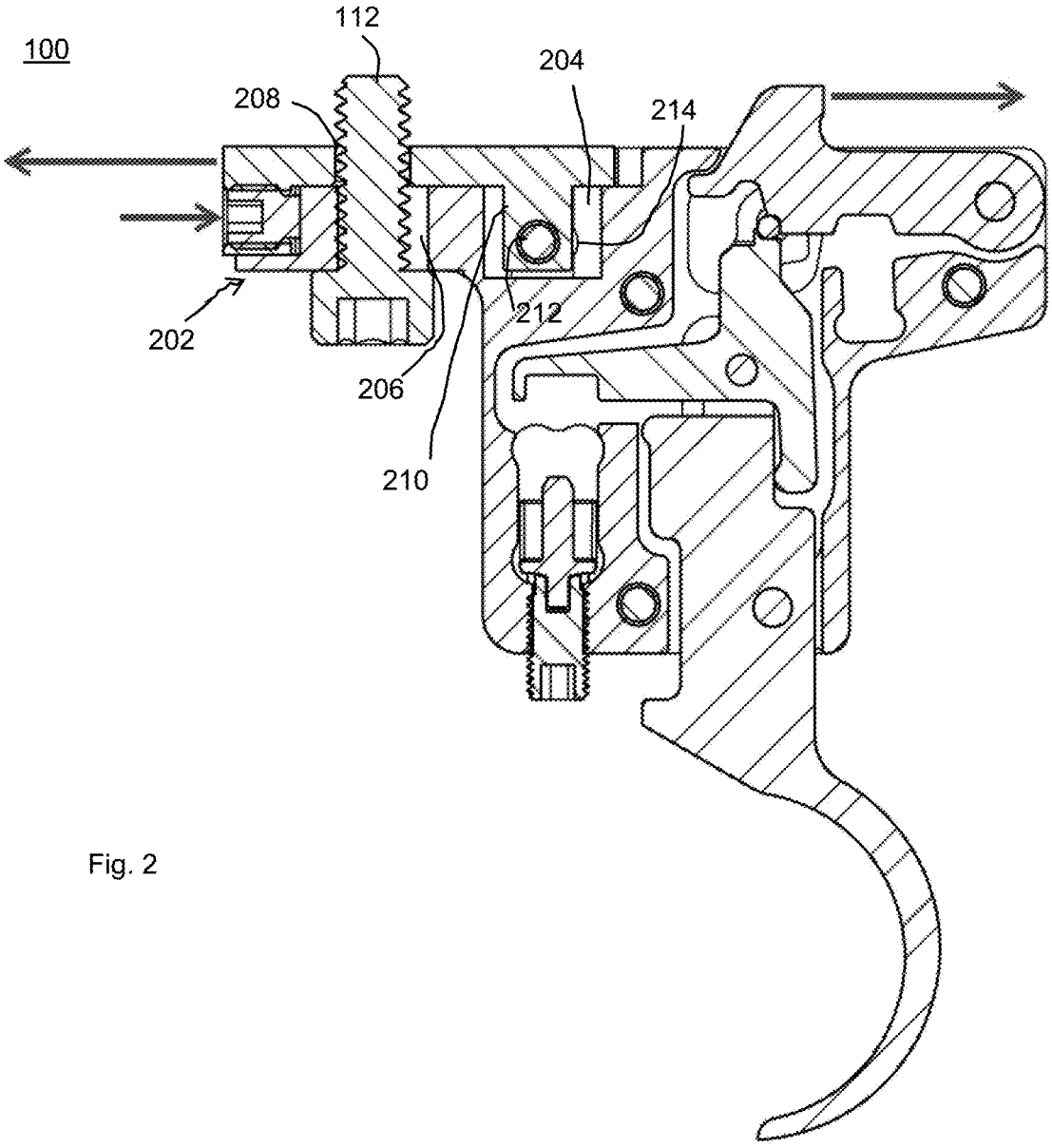
FIG. 2. is a cross-section view of the trigger assembly shown in FIG. 1.

Referring to FIG. 2, a cross-section view of the trigger assembly is shown. The main body 102 includes a flange 202 protruding therefrom. The slide adjuster 106 is positioned proximal an edge of the flange 202 to facilitate access thereto. The flange 202 includes a channel 204. The channel 204 and the slider 104 are shaped to be complementary to each other, so that the slider 104 fits with the channel 204. The width of the channel 204 is similar to the width of the slider 104. The length of the channel 204 is longer that the slider 104 to allow for lateral movement of the slider 104.

The flange 202 includes a flange bore 206. The slider 104 includes a slider bore 208. In this embodiment, the flange bore 206 and the slider bore 208 are cylindrical and the circumference of the flange bore 206 is larger than the circumference of the slider bore 208. The flange bore 206 and the slider bore 208 are substantially aligned to receive a fastener 112, such as a screw for example, therethrough. The slider bore 208 is sized to snugly receive the fastener 112 and inhibit lateral motion of the fastener 112 therein. The flange bore 206 is sized to permit lateral motion of the faster 112 therein.

The slider 104 also comprises a protrusion 210, distal from the edge of the flange 202, extending substantially perpendicular therefrom. The slider 104 is coupled to the main body 102 by a coupling pin 212. The coupling pin 212 extends through the protrusion 210 and is received by a pair of opposing slots 214 in the main body 102. The slots 214 facilitates limited lateral movement of the coupling pin 212, but inhibit other motion.

Lateral movement of the slider 104 in the channel 204 can be restricted by the size of the flange bore 206, the size of the channel 204, the length of the slot 214, or any combination thereof.

The fastener 112 is configured to fixedly couple the trigger assembly 110 to the firearm. The firearm includes a recess to receive the fastener 112. If the fastener 112 is a screw, the recess will be threaded to complement the fastener 112. Accordingly, the fastener 112 couples the trigger assembly 100 to the firearm at a predefined position on the firearm.

When attaching the trigger assembly 100 to the firearm, the faster 112 is inserted through both the flange bore 206 and the slider bore 208. The fastener 112 is then inserted into the recess in the firearm and loosely tightened. Loosely tightening the fastener 112 holds it in place but allows relative movement between the slider 104 and the main body 102. Because of the relatively snug fit of the fastener 112 within the slider bore 206, there will be little absolute movement of the slider 104. Since the position of the slider 104 is fixed with respect to the firearm, adjustment of the slider 104 will result in relative movement of the sear 110.

In an embodiment, the slider 104 is loosely slideable within the channel 104. Accordingly, the main body 102 can be manually manipulated to position the sear 110. Once the lateral position of the sear 110 is determined, the slide adjuster 106 is used to set the sear 110 in place. In an alternative embodiment, the slider 104 moves in response to adjustment of the slide adjuster 106. Accordingly, adjustment of the slide adjuster 106 lengthens or shortens the distance between the fastener 112 and the sear 110. In both embodiments, set screws can be used to implement the slide adjuster 106.

Adjusting the lateral position of the sear 110 allows a user or manufacturer to easily position the sear 110 with respect to the cocking piece so that the notch in the firing pin assembly accurately aligns with the safety cam that is part of the bolt assembly. This simple alignment is a significant improvement to the installation process for trigger assemblies.

Once the position of the sear 110 has been set, the fastener 112 is completely tightened, connecting the trigger assembly 100 to the firearm.

The scope of the appended claims should not be limited by the preferred embodiments set forth in the examples but should be given the broadest interpretation consistent with the description as a whole.

What is claimed is:

1. A slidable trigger assembly comprising:

a main body housing a trigger and a sear;

a slider, slidably coupled with the main body; and a slide adjuster configured to adjust a position of the main body so that a position of the sear is set to a target position with respect to the slider.

2. The slidable trigger assembly of claim 1; wherein the main body comprises a flange protruding therefrom.

3. The slidable trigger assembly of claim 2; wherein the flange comprises a flange bore and the slider comprises a slider bore.

4. The slidable trigger assembly of claim 3, wherein the flange bore is larger than the slider bore.

5. The slidable trigger assembly of claim 4, wherein the flange bore and the slider bore are aligned to receive a fastener therethrough, the fastener for connecting the slidable trigger assembly to a firearm.

6. The slidable trigger assembly of claim 5, wherein the slider bore is shaped to snugly receive the fastener.

7. The slidable trigger assembly of claim 2, wherein the flange comprises a channel shaped to receive the slider.

8. The slidable trigger assembly of claim 7, wherein the slider includes a protrusion, distal from an edge of the flange, the protrusion extending perpendicularly into the channel.

9. The slidable trigger assembly of claim 8, wherein the main body comprises a pair of opposing slots, and the protrusion is coupled to the main body by a pin extending through the protrusion between the opposing slots.

10. The slidable trigger assembly of claim 1, wherein the slider is loosely coupled with the main housing, and the slide adjuster is configured to set the position of the sear in place once it has been determined.

11. The slidable trigger assembly of claim 1, wherein the sear moves laterally with respect to the slider in response to adjustment of the slide adjuster.

12. The slidable trigger assembly of claim 1, wherein the slide adjuster comprises a set screw.

13. A slidable trigger assembly comprising:

a main body housing a trigger and a sear, the main body comprising a flange having a flange bore; and a slider external to the main body, the slider being slidably couplable with the main body, the slider comprising a slider bore smaller than the flange bore, wherein the flange bore is configured to be aligned with the slider bore to receive a fastener therethrough.

14. The slidable trigger assembly of claim 13, wherein the slider bore is shaped to snugly receive the fastener.

15. The slidable trigger assembly of claim 13, wherein the main body comprises a channel shaped to receive the slider.

16. The slidable trigger assembly of claim 13, wherein the slider includes a protrusion, distal from an edge of the main body, the protrusion extending perpendicularly into the channel.

17. The slidable trigger assembly of claim 16, wherein the main body comprises a pair of opposing slots, and the protrusion is coupled to the main body by a pin extending through the protrusion between the opposing slots.

18. The slidable trigger assembly of claim 13, wherein the sear moves laterally with respect to the slider in response to physical manipulation of the slidable trigger assembly to set the sear at a target position with respect to the slider.

* * * * *